United States Patent [19]

Kienzle et al.

[11] Patent Number: 4,650,122

[45] Date of Patent: Mar. 17, 1987

[54] METHOD FOR PREPARING FUEL AND INJECTION VALVE FOR PERFORMING THE METHOD

[75] Inventors: Wolfgang Kienzle; Werner Paschke, both of Schwieberdingen; Rudolf Sauer, Benningen; Heinrich Knapp, Leonberg, all of Fed. Rep. of Germany

[73] Assignee: Robert Bosch GmbH, Stuttgart, Fed. Rep. of Germany

[21] Appl. No.: 823,144

[22] Filed: Jan. 29, 1986

Related U.S. Application Data

[63] Continuation-in-part of Ser. No. 371,833, Apr. 26, 1982, abandoned.

[30] Foreign Application Priority Data

Apr. 29, 1981 [DE] Fed. Rep. of Germany ..... 3116954

[51] Int. Cl.[4] ..... F02M 69/04; F02M 61/04

[52] U.S. Cl. ..... 239/497; 239/533.12; 239/585

[58] Field of Search ..... 239/533.12, 585, 494, 239/497

[56] References Cited

U.S. PATENT DOCUMENTS

| | | | |
|---|---|---|---|
| 4,033,513 | 7/1977 | Long | 239/585 |
| 4,245,789 | 1/1981 | Gray | 239/585 |
| 4,311,280 | 1/1982 | Knape | 239/585 |
| 4,394,973 | 7/1983 | Sauer et al. | 239/463 |

FOREIGN PATENT DOCUMENTS

| | | | |
|---|---|---|---|
| 709681 | 6/1954 | United Kingdom | 239/497 |

*Primary Examiner*—Andres Kashnikow
*Attorney, Agent, or Firm*—Edwin E. Greigg

[57] ABSTRACT

An injection valve for preparing fuel injected into an intake tube of an internal combustion engine and an injection valve for performing the method are proposed. The injection valve includes a movable valve element, which cooperates with a fixed valve seat, downstream of which the fuel reaches fuel guide bores inclined relative to the valve axis and this fuel discharges into a preparation bore at a distance (a) on the bottom from the wall. The fuel flowing via the fuel guide bores at first exits freely from the discharge openings of the fuel guide bores into the preparation bore and subsequently arrives at the wall of the preparation bore, from where it flows in the form of a film, distributed over the wall, toward the open end of the preparation bore and is ejected into the aspirated air of the internal combustion engine.

6 Claims, 3 Drawing Figures

METHOD FOR PREPARING FUEL AND INJECTION VALVE FOR PERFORMING THE METHOD

This is a continuation-in-part of copending application Ser. No. 371,833 filed Apr. 26, 1982, now abandoned.

BACKGROUND OF THE INVENTION

The invention is based on a method for preparing fuel and an injection valve for preforming the method. A method and an injection valve are already known in which for the purpose of fuel preparation, the fuel is carried via spin conduits directly downstream of a valve seat, entering a spin chamber at a tangent so as finally to be ejected into the intake tube while maintaining the spin. Particularly at low fuel pressures and short injection times, a spin preparation of this kind is not, however, capable of meeting requirements for the thinnest possible fuel film exiting from the injection valve, while maintaining a constant angle of ejection, depending on the duration of injection, and good uniformity of distribution.

OBJECT AND SUMMARY OF THE INVENTION

The method according to the invention for preparation of fuel injected into an intake tube of an internal combustion engine has the advantage over the prior art that the angle of ejection of the fuel is virtually independent of the fuel pressure or the duration of injection, and a very thin fuel film is generated as it exits from the injection valve, so that uniformly fine distribution of the fuel in the aspirated air flowing in the intake tube is accomplished. The consequence is a minimization both of engine fuel consumption and of the proportion of toxic components in the engine exhaust.

The injection valve according to the invention for performing the method for preparation of fuel has the advantage of a simple and cost-favorable embodiment, with which very good fuel preparation can be attained.

It is particularly advantageous to dispose the discharge openings of the fuel guide bores near the longitudinal axis of the injection valve, in order to reduce the clearance space of a collecting chamber downstream of the valve seat.

The invention will be better understood and further objects and advantages thereof will become more apparent from the ensuing detailed description of two preferred embodiments taken in conjunction with the drawings.

DESCRIPTION OF THE PREFERRED EMBODIMENTS

Figure 1:
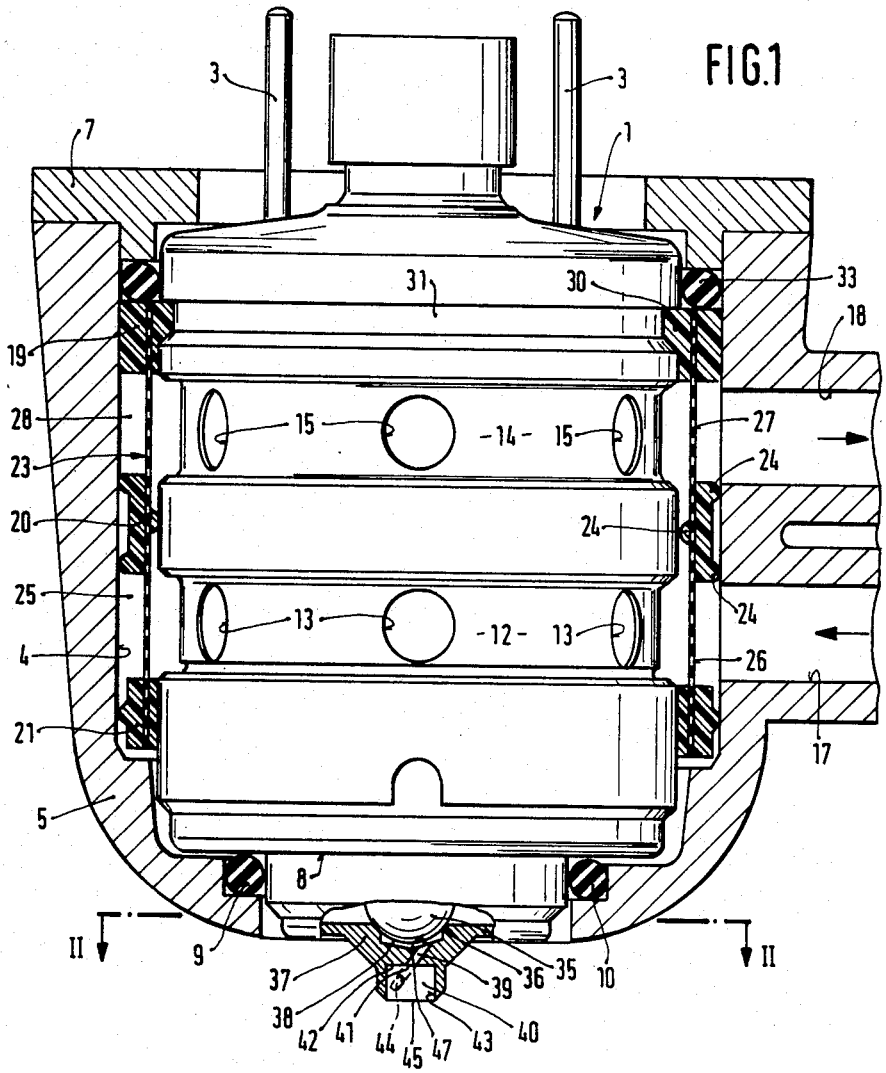
FIG. 1 shows one exemplary embodiment of a fuel injection valve.

The fuel injection valve 1 shown in FIG. 1 is electromagnetically actuatable in a known manner and serves by way of example to inject fuel, in particular at a relatively low pressure, into the air intake tube of mixture-compressing internal combustion engines with externally-supplied ignition. The injection of fuel through the fuel injection valve may be effected either simultaneously for all the cylinders of the engine into the air intake tube upstream or downstream of a throttle valve through a single fuel injection valve, or by means of one fuel injection valve each into the individual air intake tubes directly prior to each inlet valve of each cylinder of the engine. The electrical triggering of the fuel injection valve may be effected in a known manner via contact prongs 3. The fuel injection valve is supported in a guide opening 4 of a holder body 5 and may be fixable by way of example in the axial direction by a claw or a cap 7. In addition, a sealing ring 10 rests on one end face 8 of the fuel injection valve, remote from the cap 7, and is supported on the other end on a step 9 of the holder body 5. The holder body 5 may be embodied by the air intake tube wall itself or may be an independent element. The fuel injection valve 1 has an annular fuel supply groove 12, from which fuel supply openings 13 lead into the interior of the fuel injection valve 1. Axially offset from the fuel supply groove 12 and as shown above this groove in the drawing, the fuel injection valve 1 also has a fuel discharge groove 14 of annular embodiment, from which fuel discharge openings 15 lead into the interior of the fuel injection valve 1. A fuel supply line 17 discharges into the fuel supply groove 12 and communicates in a manner not shown with a fuel supply source, for instance a fuel pump. The fuel flowing into the fuel supply groove 12 via the fuel supply line 17 reaches the interior of the fuel injection valve 1 and is either ejected into the air intake tube or flows through the fuel injection valve in order to absorb heat from it and exits via the fuel discharge openings 15 into the fuel discharge groove 14, which communicates with a fuel outflow line 18 embodied within the holder body 5. The fuel injection valve is guided radially within the guide opening 4 of the holder body 5 by means of elastic support bodies 19, 20, 21 of a fuel filter 23, which extends in the axial direction, covering the fuel supply groove 12 and the fuel outflow groove 14. The support bodies 19, 20, 21 are fabricated of some elastic material, such as rubber or plastic. The middle support body 20 in particular is an annular embodiment, such that, being provided by way of example with sealing noses 24, it is supported on the circumference of the fuel injection valve 1, between the fuel supply groove 12 and the fuel discharge groove 14 on one end and on the other end on the guide opening 4; thus it seals off the fuel supply groove 12 and the fuel supply line 17 relative to the fuel outflow groove 14 and the fuel discharge line 18. The fuel flowing in via the fuel supply line 17 first reaches an annular groove 25 embodied between the middle support body 20 and the lower end support body 21 of the fuel filter; from this annular groove 25, the fuel can flow via the filter area 26 into the fuel supply groove 12. The fuel can flow out of the fuel discharge groove 14 via the filter area 27 into an annular groove 28 embodied between the upper end support body 19 and the middle support body 20 of the fuel filter 23, and this annular groove 28 communicates with the fuel discharge line 18. By means of the filter areas 26, 27, particles of dirt contained in the fuel are filtered out. Particularly as a result of the elastic embodiment of the middle support body 20, the element is simpler to make, and greater tolerances are possible at the circumference of the fuel injection valve 1 and of the diameter of the guide opening 4. The upper support body 19 may be provided on its side oriented toward the fuel injection valve 1 with a detent nose 30, which when the fuel filter 23 is pushed onto the fuel injection valve 1 snaps into a detent groove 31 of the fuel injection valve 1; the result is that the fuel injection valve 1 can be inserted in common with the mounted fuel filter 23 into the guide opening 4 of the holder body 5. A sealing ring 33 may also be axially supported on the upper support body 19, being disposed between the fuel injection valve 1 and the holder body 5 and fixed in place on the other end by the cap 7.

The fuel injection valve 1 has a movable valve element 35, which is embodied as spherical, by way of example, and cooperates with a correspondingly shaped fixed valve seat 36 in a nozzle body 37. The movable valve element 35 is lifted from the valve seat when the electromagnet of the fuel injection valve 1 is excited, so that fuel can flow past between the movable valve element 35 and the valve seat 36 and reaches a collecting chamber 38 whose volume is as small as possible not greater than 0.3 $mm^3$. It is also to be noted that the movable valve and its valve seat circumscribe an enclosed area which forms the collecting chamber 38. From the collecting chamber 38, fuel guide bores 39, which are inclined at an angle (see FIG. 3) relative to the valve axis, lead to a preparation bore 40 also embodied in the nozzle body 37. At last two fuel guide bores 39 are provided; in FIG. 2, by way of example, six fuel guide bores 39 are shown, uniformly offset relative to one another with the inlet end of each fuel guide bore spaced from the valve axis by a maximum distance of about three times the diameter of the fuel guide metering bores. The fuel guide bores 39 terminate in discharge openings 41 on the bottom of the preparation bore 40, which is embodied as a blind bore, in such a way that no tangentially-directed inflow into the cylindrically embodied preparation bore 40 occurs. Instead, the discharge openings 41 are disposed on the bottom 42 by a distance a from the wall 43 of the cylindrical preparation bore 40, so that the fuel, exiting the fuel guide bores 39 in the form of a stream as indicated by the broken lines in the drawing, at first exits freely from the discharge opening 41, without touching the wall, and passes via an approximately elliptical impact face 44, shown in broken lines, to arrive in a distributed manner on the wall 43 of the preparation bore 40. The curvature of the preparation bore gives the impact face 44 a larger surface area than the discharge opening 41. The fuel arriving at the wall 43 of the preparation bore 40 distributes itself in the form of a film on the wall 43 and flows in an approximately parabolic path toward the open end 45 of the preparation bore 40. The fuel film is torn off from the nozzle body 37 at this open end 45, which is embodied as sharply pointed, and enters the aspirated air flow as a fuel film, whereupon uniform mixing of air and fuel occurs, which is a precondition for low fuel consumption and small amounts of toxic components in the engine exhaust. The preparation bore 40 is preferably embodied as so long that the fuel, exiting in the form of a stream from the discharge openings 41, arrives at the wall 43 of the preparation bore 40 near the open end 45. As a result, as little of the energy of the fuel stream as possible is lost from friction at the wall 43. The fuel guide bores 39 simultaneously serve as fuel metering bores and have a diameter of approximately 0.2 mm, for example. The angle of inclination $\alpha$ of the fuel guide bores 39 relative to the valve axis is preferably between 5° and approximately 70°, so that the fuel streams arrive in the form of an acute angle at the wall 43 of the preparation bore 40.

Figure 2:
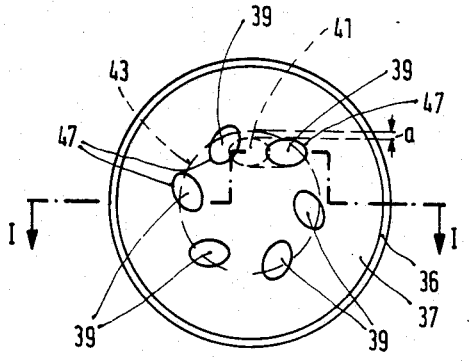
FIG. 2 is a sectional view taken along the line II—II of FIG. 1.
Figure 3:
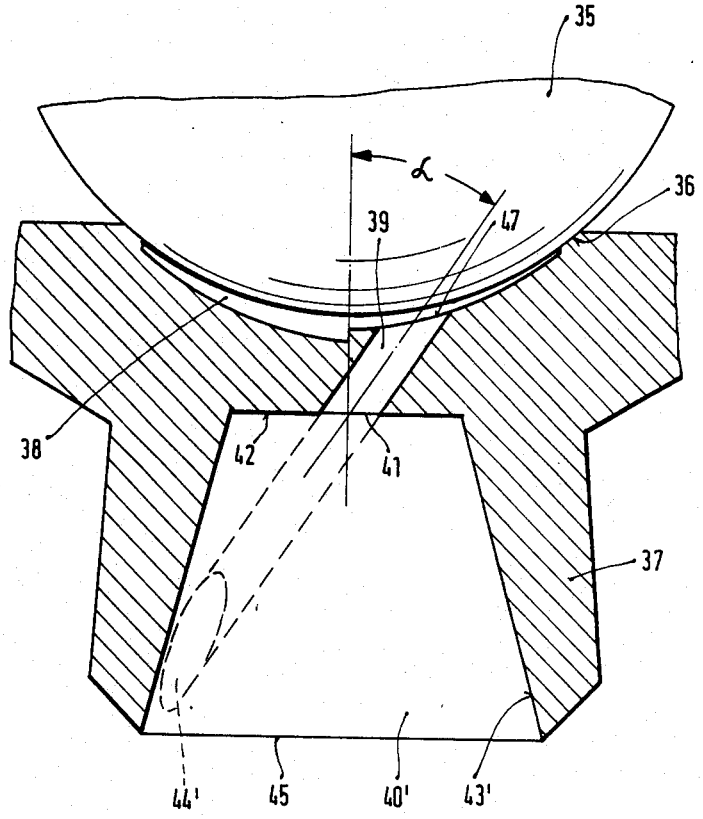
FIG. 3 shows a further exemplary embodiment of a fuel injection valve in a fragmentary sectional view.

For the illustration of the section II—II of FIG. 2, the scale was changed from that of FIG. 1. In the exemplary embodiment of FIG. 3, only the preparation bore 40' has been changed in comparison with the exemplary embodiment of FIG. 1, and the change is such that this bore 40' is embodied as widening in the flow direction in conical fashion. As a result, there is an enlargement of the approximately elliptical impact face 44' at the conically extending wall 43' of the preparation bore 40'. The length of the preparation bore 40' is likewise advantageously designed such that the fuel exiting from the discharge openings 41 arrives at the wall 43' of the preparation bore 40' near the open end 45.

In order to be able to embody the collecting chamber 38 with the smallest possible clearance volume, it is advantageous to dispose the discharge openings 47 of the fuel guide bores 39 from the collecting chamber 38 close to the longitudinal axis of the injection valve.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An injection valve for injecting fuel into an intake tube of an internal combustion engine, which comprises:

a nozzle body in coaxial relationship with said injection valve;

a fixed valve seat in said nozzle body in coaxial relationship with said nozzle body;

a fuel collection chamber in said nozzle body downstream of said fixed valve seat;

said fuel collection chamber having a minuscule volume no greater than 0.3 $mm^3$ circumscribed by said fixed valve seat;

a movable valve element which is arranged to cooperate with said fixed valve seat to enclose said fuel collection chamber;

a preparation bore in said nozzle body downstream of said fuel collection chamber embodied as a cylindrically-shaped blind bore having a bottom, an open end which is in communication with the intake tube, and a wall extending between the bottom and the open end of the blind bore; and a plurality of fuel guide metering bores extending from said fuel collection chamber through said bottom of said preparation bore, each of said fuel guide bores having an axis inclined at an angle $\alpha$ between the bore axis and a plane that passes along the axis of said nozzle body which plane intercepts said axis of said bore with the interception of the bore axis with the plane spaced from the axis of the body; each of said fuel guide metering bores have an inlet opening disposed in said fuel collection chamber spaced equidistant from said axis of said nozzle body by a maximum distance of about three times the diameter of each of said fuel guide metering bores and equidistant from each other for receiving fuel from said fuel collection chamber and each of said fuel guide metering bores includes a discharge opening in the bottom of the preparation bore which is spaced from the wall of the preparation bore, whereby fuel injected into the preparation bore through each of said fuel guide metering bores first enters into the preparation bore in the form of a free stream which does not contact a portion of the bore wall adjacent each fuel guide bore discharge opening and subsequently impinges at an acute angle on a portion of the bore wall downstream of said portion of said bore adjacent each fuel guide bore discharge opening, from which the fuel flows in the form of a film and is distributed over the bore wall, toward the open end of the preparation bore.

2. An injection valve as defined in claim 1, wherein the portion of the bore wall on which the fuel impinges is disposed in proximity to the open end of the bore.

3. An injection valve as set forth in claim 1 wherein the outlet of said fuel guide bores is such that the fuel flow is non-tangential with said wall of said blind bore.

4. An injection valve as set forth in claim 3 wherein the angle of inclination of each of said fuel guide bores is between approximately 5 degrees and approximately 70 degrees such that the fuel arrives at said bore wall in the form of an acute angle.

5. An injection valve for injecting fuel into an intake tube of an internal combustion engine, which comprises:

a nozzle body in coaxial relationship with said injection valve;

a fixed valve seat in said nozzle body in coaxial relationship with said nozzle body;

a fuel collection chamber in said nozzle body downstream of said fixed valve seat;

said fuel collection chamber having a minuscule volume no greater than 0.3 $mm^3$ circumscribed by said fixed valve seat;

a movable valve element which is arranged to cooperate with said fixed valve seat to enclose said fuel collection chamber;

a preparation bore in said nozzle body downstream of said fuel collection chamber embodied as a blind bore having a bottom, an open end which is in communication with the intake tube, and a wall extending between the bottom and the open end of the blind bore;

said wall of said preparation bore widening conically in a direction of fuel flow;

a plurality of fuel guide metering bores extending from said fuel collection chamber through said bottom of said preparation bore, each of said fuel guide bores having an axis inclined at an angle $\alpha$ between the bore axis and a plane that passes along the axis of said nozzle body which plane intercepts said axis of said bore with the interception of the bore axis with the plane spaced from the axis of the body;

each of said fuel guide metering bores have an inlet opening disposed in said fuel collection chamber spaced equidistant from said axis of said nozzle body by a maximum distance of about three times the diameter of each of said fuel guide metering bores and equidistant from each other for receiving fuel from said fuel collection chamber and each of said guide metering bores includes a discharge opening in the bottom of the preparation bore which is spaced from the adjacent wall portion of the preparation bore, whereby fuel injected into the preparation bore through each of said fuel guide metering bores first enters into the preparation bore in the form of a free stream which does not contact a portion of the bore wall adjacent each fuel guide bore discharge opening and subsequently impinges at an acute angle on a portion of the bore wall downstream of said wall portion adjacent each fuel guide bore discharge opening, from which the fuel flows in the form of a film and is distributed over the bore wall, toward the open end of the conically widening preparation bore.

6. An injection valve as defined in claim 5 wherein the portion of the bore wall on which the fuel impinges is disposed in proximity to the open end of the bore.

* * * * *